US009056512B1

(12) United States Patent
Kanzaki

(10) Patent No.: US 9,056,512 B1
(45) Date of Patent: Jun. 16, 2015

(54) PRINTING APPARATUS AND METHOD FOR DETECTING DEFECTIVE JETTING NOZZLE OF PRINTING APPARATUS

(71) Applicant: Brother Kogyo Kabushiki Kaisha, Nagoya-shi, Aichi-ken (JP)

(72) Inventor: Shotaro Kanzaki, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/635,241

(22) Filed: Mar. 2, 2015

(30) Foreign Application Priority Data

Mar. 31, 2014 (JP) ..... 2014-072208

(51) Int. Cl.
*B41J 2/045* (2006.01)
*B41J 29/393* (2006.01)

(52) U.S. Cl.
CPC ..... *B41J 29/393* (2013.01); *B41J 2/04501* (2013.01)

(58) Field of Classification Search
CPC .... B41J 2/16579; B41J 29/393; B41J 2/2142; B41J 2/0451; B41J 2/125; B41J 2/2139; B41J 2/04596; B41J 2/165; B41J 2/04558
USPC ..... 347/9, 12, 14, 19, 20, 37, 40, 81
See application file for complete search history.

(56) References Cited

U.S. PATENT DOCUMENTS 7,950,761 B2 * 5/2011 Komatsu et al. ..... 347/11
2014/0232773 A1 * 8/2014 Hamazaki et al. ..... 347/14

FOREIGN PATENT DOCUMENTS

JP 2009-172934 8/2009

* cited by examiner

*Primary Examiner* — Thinh Nguyen
(74) *Attorney, Agent, or Firm* — Frommer Lawrence & Haug LLP

(57) ABSTRACT

There is provided a printing apparatus comprising: a printhead; a recovery mechanism for the printhead; a jetting failure detector; an operation history memory; a detection condition memory, the jetting failure detector; and a controller. The controller in configured to control the printing apparatus to: determine whether or not the operation history of the printhead conforms to the first condition value; determine whether or not the jetting failure is present, in a case that, the operation history conforms to the first condition value; cause the recovery mechanism to perform the recovery process, in a case that, the jetting failure is present; and cause the detection condition memory to store the second condition value smaller than the first condition value as a new first condition value, in a case that the jetting failure is present.

7 Claims, 11 Drawing Sheets

PRINTING APPARATUS AND METHOD FOR DETECTING DEFECTIVE JETTING NOZZLE OF PRINTING APPARATUS

CROSS REFERENCE TO RELATED APPLICATION

The present application claims priority from Japanese Patent Application No. 2014-072208 filed on Mar. 31, 2014 the disclosure of which is incorporated herein by reference in its entirety.

BACKGROUND OF THE INVENTION

1. Field of the Invention

The present invention relates to a printing apparatus and a method for detecting a defective jetting nozzle of a printing apparatus.

2. Description of the Related Art

An ink-jet printer using a line head having a print range equal to or more than a width of a printing medium has been known. In this line head, nozzles which jet ink are disposed to face a region extending over the whole width of the printing medium. When printing is performed continuously, paper powder accumulates in a casing of the ink-jet printer. When the paper powder adheres on a nozzle surface of the line head, this nozzle suffers a jetting failure such as defective jetting and jetting amount fluctuation. Consequently, void lines or blurs are formed on the printing medium, resulting in great deterioration in image quality.

It has been known a printing system which performs the jetting failure detection when it is determined, based on the setting by a user, that jetting failure detection should be performed, and if the number P of printed copies after the jetting failure detection performed last time is equal to or more than a predetermined number Pth. In this printing system, the jetting failure detection is performed every predetermined number Pth being a threshold value set in advance by the user. When a defective jetting nozzle is detected, a predetermined recovery operation is performed. Consequently, the defective jetting nozzle is accurately detected and a state in which no defective jetting nozzle exists can be realized.

However, in the above-described conventional printing system, in a case that it is determined, based on the setting by the user, that the jetting failure detection should be performed, the jetting failure detection is always performed every time the number P of printed copies after the jetting failure detection performed last time reaches the predetermined number Pth or more. Therefore, even if no jetting failure is detected in the current jetting failure detection, the next jetting failure detection is performed when the number P of printed copies after the current jetting failure detection reaches the predetermined number Pth or more. Depending on printing paper used, a speed at which the paper powder accumulates in the casing differs. The conventional printing system has a problem of wasteful detection, because the jetting failure detection is performed every time the number of printed copies reaches the predetermined number Pth, even if no jetting failure occurs in the printing during a period up to the predetermined number Pth, unless the setting of the predetermined number Pth is changed by the user.

SUMMARY

It is an object of the present teaching to solve the aforesaid problem and to provide a printing apparatus which does not perform unnecessary jetting failure detection and a method of detecting a defective jetting nozzle of the printing apparatus.

In order to solve the above problem, a printing apparatus according to one aspect of the present teaching includes: a printhead including a plurality of nozzles configured to jet a liquid to a recording medium;

a recovery mechanism configured to perform a recovery process of the printhead;

a jetting failure detector configured to detect a presence of a jetting failure of the liquid from the printhead;

an operation history memory configured to store an operation history of the printhead;

a detection condition memory configured to store a first condition value of the operation history, the jetting failure detector performing a detection to detect the presence of the jetting failure based on the first condition value; and a controller configured to control the printing apparatus, wherein the controller is configured to control the printing apparatus to:

determine whether or not the operation history of the printhead conforms to the first condition value stored in the detection condition memory;

cause the jetting failure detector to perform a first detection to detect the presence of the jetting failure of the liquid from the printhead and determine whether or not the jetting failure of the liquid is present, in a case that, the operation history of the printhead is determined to conform to the first condition value;

cause the recovery mechanism to perform the recovery process of the printhead, in a case that, the jetting failure of the liquid from the printhead is determined to be present based on the first detection; and create a second condition value smaller than the first condition value and cause the detection condition memory to store the second condition value as a new first condition value, in a case that, the jetting failure of the liquid from the printhead is determined to be present based on the first detection.

In this structure, when it is detected that the jetting failure has occurred before the operation history conforms to the first condition value stored in the detection condition memory, the controller controls the printing apparatus to create the second condition value smaller than the first condition value and cause the detection condition memory to store the second condition value as a new first condition value. Therefore, the first condition value can be set to a new condition value smaller than the current first condition value, which makes it possible to shorten a period in which the printing is continued with the presence of the jetting failure.

A method for detecting a defective jetting nozzle of a printing apparatus according to a second aspect of the present teaching is a method for detecting a defective jetting nozzle of a printing apparatus, the printing apparatus including:

a printhead including a plurality of nozzles configured to jet a liquid to a recording medium;

a recovery mechanism configured to perform a recovery process of the printhead;

a jetting failure detector configured to detect a presence of a jetting failure of the liquid from the printhead;

an operation history memory configured to store an operation history of the printhead;

a detection condition memory configured to store a first condition value of the operation history, the jetting failure detector performing a detection to detect the presence of the jetting failure based on the first condition value; and a controller configured to control the printing apparatus, the method including:

determining whether or not the operation history of the printhead conforms to the first condition value stored in the detection condition memory;

causing the jetting failure detector to perform the detection to detect the presence of the jetting failure of the liquid from the printhead and determine whether or not the jetting failure of the liquid is present, in a case that, the operation history of the printhead is determined to conform to the first condition value;

causing the recovery mechanism to perform the recovery process of the printhead, in a case that, the jetting failure of the liquid from the printhead is determined to be present; and creating a second condition value smaller than the first condition value and causing the detection condition memory to store the second condition value as a new first condition value, in a case that, the jetting failure of the liquid from the printhead is determined to be present.

DESCRIPTION OF THE EMBODIMENTS

Hereinafter, an embodiment of the present teaching will be explained with reference to the drawings. In the following embodiment, the "printing apparatus" according to the present teaching is applied to an ink-jet printer 10, and a sheet P is used as a "recording medium". Further, as an example of an "operation history" of an inkjet head 14, the number of printed copies is used, with printing for one page of the sheet P being one unit. A state where desired ink droplets 14B are not jetted when the ink droplets 14B should be jetted from a nozzle 14A of the inkjet head 14 is referred to as "defective jetting" or "jetting failure". "Front, rear, left, and right" directions in the following explanation are defined based on a view of a user operating the ink jet printer 10, and thus, a near side, a far side, a left side and a right side for the user is defined as the front, the rear, the left and the right, respectively.

Figure 1:
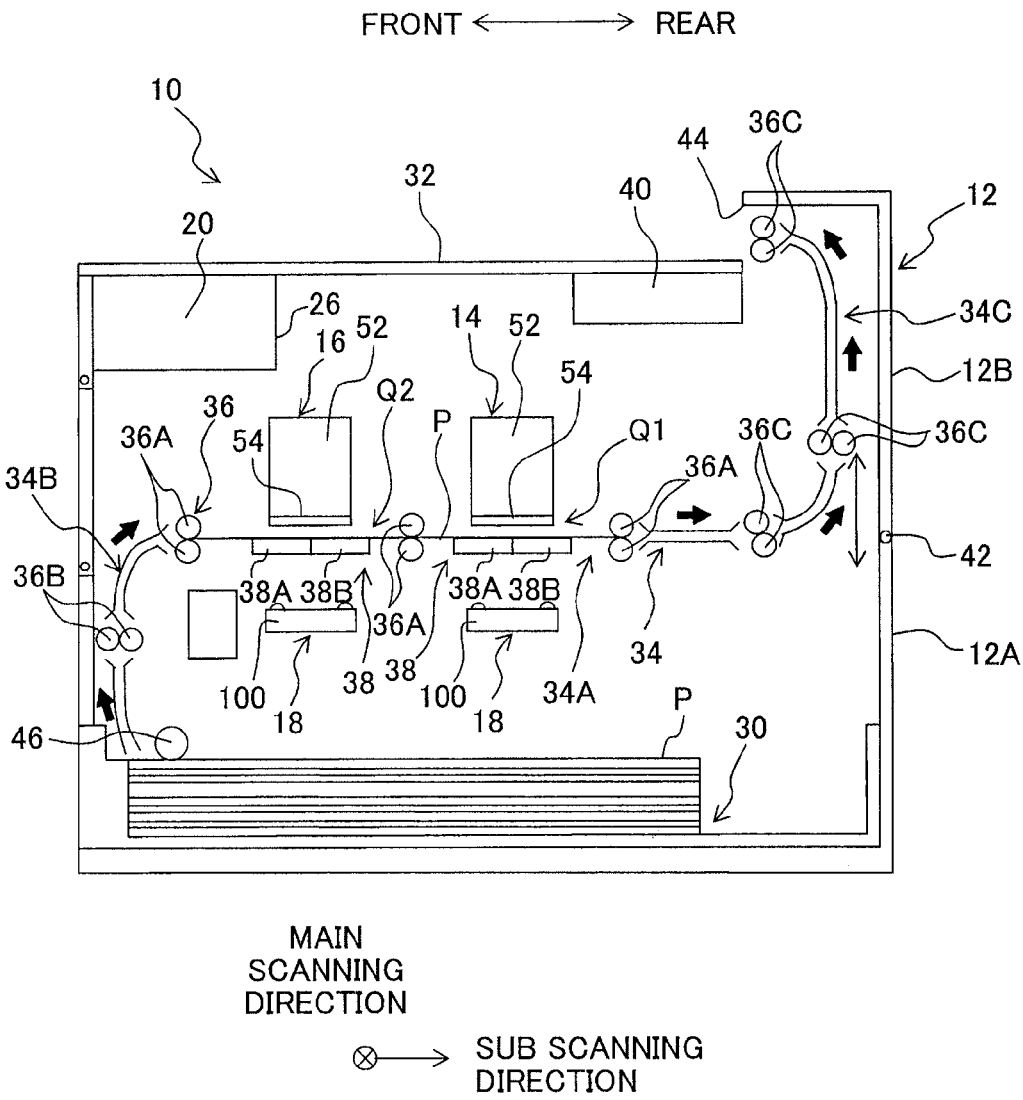
FIG. 1 is a schematic view depicting an internal structure of an ink-jet printer according to an embodiment.

As depicted in FIG. 1, the ink-jet printer 10 includes a casing 12, the inkjet head 14 which jets ink to the sheet P in order to record an image on the sheet P in a predetermined recording region Q1, a treatment liquid jetting head 16 which jets a treatment liquid to the sheet P in a predetermined pre-treatment region Q2, and a maintenance unit 18 which does maintenance of the inkjet head 14 and the treatment liquid jetting head 16.

Figure 2:
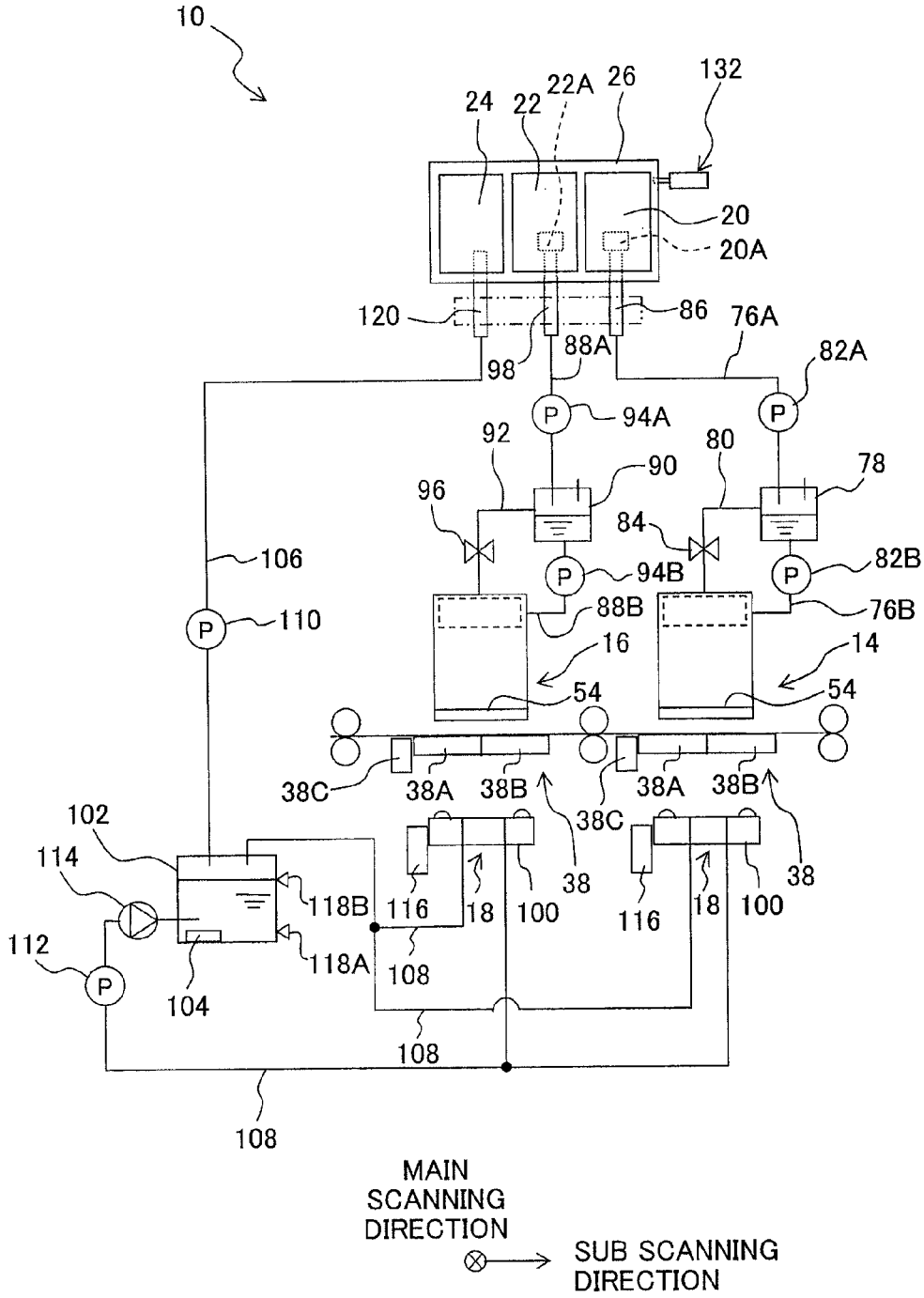
FIG. 2 is a conceptual view depicting the structure of an essential part of the ink-jet printer.

Further, as depicted in FIG. 2, the ink-jet printer 10 includes an ink tank 20 which stores the ink, a treatment liquid tank 22 which stores the treatment liquid, a humidifying liquid tank 24 which stores a humidifying liquid, and a tank installation unit 26 in which these liquid tanks 20, 22, 24 are attachably/detachably installed. As the treatment liquid, one which flocculates or precipitates components of the ink is used. For example, for a pigment ink, a treatment liquid which flocculates a pigment color is used, and for a dye ink, a treatment liquid which precipitates a dye color is used. A material of the treatment liquid can be appropriately selected from liquids containing a cationic compound especially a cationic high polymer or a cationic surfactant, polyvalent metallic salt such as calcium salt or magnesium salt, and the like. When the ink lands on the surface of the sheet P coated with any of these treatment liquids, the polyvalent metallic salt or the like acts on a dye or a pigment being a coloring agent of the ink, so that an insoluble metal composite, a metal composite which is hard to solve, etc. is formed by flocculation or precipitation. As a result, an infiltration index of the ink into the sheet P lowers, which facilitates fixing of the ink on the sheet P.

Further, as depicted in FIG. 1, the ink-jet printer 10 includes a sheet storage unit 30 which stores the sheet P, a discharge unit 32 to which the sheet P on which an image is recorded in the recording region Q1 is discharged, a conveyance path 34 which is a path for conveying the sheet P from the sheet storage unit 30 to the discharge unit 32 via the pre-treatment region Q2 and the recording region Q1, a conveying force applier 36 which applies, to the sheet P, a conveying force for conveying the sheet P through the conveyance path 34, two platens 38 provided in the conveyance path 34 and which support the sheet P in the recording region Q1 and the pre-treatment region Q2, respectively, and a control unit 40 which executes various control operations.

As depicted in FIG. 1, the casing 12 includes a lower casing 12A in a substantially rectangular parallelepiped shape whose upper surface is open, an upper casing 12B in a substantially parallelepiped shape whose lower surface is open, and a rotary shaft 42 which supports the upper casing 12B at the rear portion of the lower casing 12A so as to allow the upper casing 12B to swing. Therefore, it is possible to swing the upper casing 12B upward around the rotary shaft 42, which makes it possible to reserve work space at the time of the maintenance. As depicted in FIG. 1, in the rear portion of the upper surface of the upper casing 12B, a sheet discharge port 44 which discharges the sheet P toward the discharge unit 32 is provided. As depicted in FIG. 2, inside the upper casing 12B, the ink tank 20, the treatment liquid tank 22, the humidifying liquid tank 24, the tank installation unit 26, and a lock mechanism 132 are provided.

As depicted in FIG. 1, the conveyance path 34 includes a horizontal path 34A for conveying the sheet P in a horizontal direction in the pre-treatment region Q2 and the recording region Q1, a feed path 34B for conveying the sheet P stored in the sheet storage unit 30 toward the horizontal path 34A, and a discharge path 34C for conveying the sheet P which has passed the horizontal path 34A toward the discharge unit 32.

As depicted in FIG. 2, each of two platens 38 includes: two plate-shaped door members 38A, 38B each of which has a substantially quadrangular shape and which open/close like a door; and a platen opening/closing unit 38C which opens/closes the door members 38A, 38B. As depicted in FIG. 2, at the time of image recording on the sheet P, the door members 38A, 38B are closed and the platens 38 constitute parts of the horizontal path 34A (FIG. 1).

As depicted in FIG. 1, the conveying force applier 36 includes conveying rollers 36A which apply, to the sheet P, a conveying force for conveying the sheet P through the horizontal path 34A, conveying rollers 36B which apply, to the sheet P, a conveying force for conveying the sheet P through the feed path 34B, conveying rollers 36C which apply, to the sheet P, a conveying force for conveying the sheet P through the discharge path 34C, and a pickup roller 46 which takes out the sheet P in the sheet storage unit 30 to feed the sheet P to the feed path 34B.

In this embodiment, the pre-treatment region Q2 and the recording region Q1 are disposed along a front and rear direction in the horizontal path 34A, and the inkjet head 14 and the treatment liquid jetting head 16 are disposed above the recording region Q1 and the pre-treatment region Q2, respectively. A conveyance direction of the sheet P in the recording region Q1 and the pre-treatment region Q2 is a "sub-scanning direction", and a direction orthogonal to the sub-scanning direction in a horizontal plane is a "main scanning direction".

Figure 3:
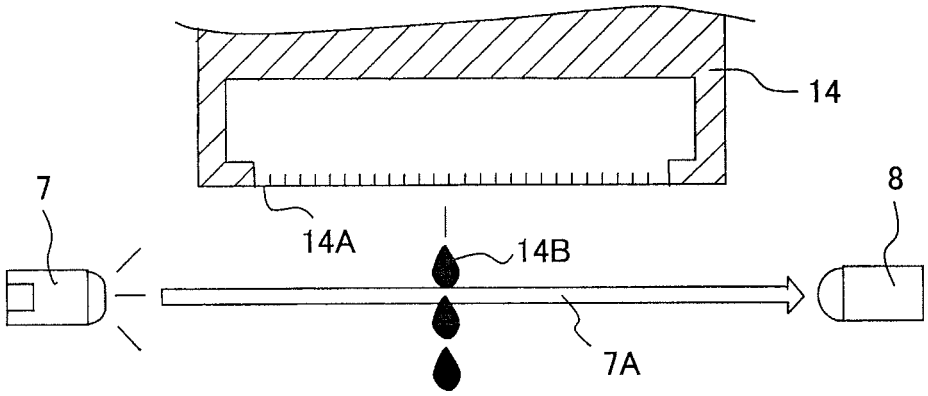
FIG. 3 is a conceptual view of a defective jetting detecting mechanism which detects defective jetting of ink droplets from nozzles of an inkjet head.

The ink-jet printer 10 is a line-type printer, and as depicted in FIG. 3, the inkjet head 14 is provided to extend in a direction which is the horizontal direction and is the main scanning direction. Note that, since the treatment liquid jetting head 16 has the same structure as that of the inkjet head 14, an explanation thereof will be omitted.

As depicted in FIG. 1, the inkjet head 14 includes a head holder 52 in a substantially rectangular parallelepiped shape provided so as to extend in the main scanning direction and a head unit 54 provided on the lower surface of the head holder 52 so as to extend in the main scanning direction. The head unit 54 includes one channel unit (not depicted) and a plurality of actuators (not depicted) bonded to the upper surface of the channel unit. The channel unit is a stack composed of a plurality of metal plates, and the lower surface of the plate constituting the lowest layer of the stack is a jetting surface (not depicted) in which a plurality of jetting ports (not depicted) are formed. Further, inside the channel unit, a manifold (not depicted), a sub-manifold (not depicted) communicating with the manifold, and a plurality of individual ink channels (not depicted) each of which extends from the sub-manifold to the jetting port via aperture (not depicted) and a pressure chamber (not depicted) are formed.

As depicted in FIG. 2, the ink tank 20 and the inkjet head 14 communicate with each other via an upstream ink channel 76A as a "first liquid channel", a sub tank 78, and a downstream ink channel 76B, and the sub tank 78 and the inkjet head 14 communicate with each other via a circulation channel 80. Further, a pump 82A is provided in the upstream ink channel 76A, a pump 82B is provided in the downstream ink channel 76B, and a valve 84 is provided in the circulation channel 80. Further, at an upstream end portion of the upstream ink channel 76A, a tubular needle 86 for ink is provided.

As depicted in FIG. 2, the treatment liquid tank 22 and the treatment liquid jetting head 16 communicate with each other via an upstream treatment liquid channel 88A as a "first liquid channel", a sub tank 90, and a downstream treatment liquid channel 88B, and the sub tank 90 and the treatment liquid jetting head 16 communicate with each other via a circulation channel 92. Further, a pump 94A is provided in the upstream treatment liquid channel 88A, a pump 94B is provided in the downstream treatment liquid channel 88B, and a valve 96 is provided in the circulation channel 92. Further, at an upstream end portion of the upstream treatment liquid channel 88A, a tubular needle 98 for treatment liquid is provided.

The maintenance unit 18 is a unit for performing maintenance (humidifying treatment) on the inkjet head 14 and the treatment liquid jetting head 16 by the humidifying liquid. As depicted in FIG. 2, the maintenance unit 18 includes two caps 100 which cover the head unit 54 of the inkjet head 14 and the head unit 54 of the treatment liquid jetting head 16 respectively, the humidifying liquid tank 24 which stores the humidifying liquid, a humidifying liquid reservoir 102 which temporary stores the humidifying liquid from the humidifying liquid tank 24, and a vaporizing device 104 such as an ultrasonic generating device which vaporizes the humidifying liquid stored in the humidifying liquid reservoir 102. The maintenance unit 18 further includes: a humidifying liquid supply channel 106 for supplying the humidifying liquid stored in the humidifying liquid tank 24 to the humidifying liquid reservoir 102; and a humidifying liquid circulation channel 108 for supplying the air humidified by the humidifying liquid stored in the humidifying liquid reservoir 102 (that is, the humidified air) to the caps 100 and returning the supplied humidified air from the caps 100 to the humidifying liquid reservoir 102. The maintenance unit 18 further includes a pump 110 provided in the humidifying liquid supply channel 106 to transfer the humidifying liquid stored in the humidifying liquid tank 24 to the humidifying liquid reservoir 102, a pump 112 provided in the humidifying liquid circulation channel 108 to circulate the humidified air between the humidifying liquid reservoir 102 and the caps 100, a check valve 114 provided in the humidifying liquid circulation channel 108, and cap lifting units 116 which lift up and down the caps 100 respectively.

As depicted in FIG. 2, on the humidifying liquid reservoir 102, a lower limit sensor 118A which detects that a liquid level of the humidifying liquid has reached a lower limit and an upper limit sensor 118B which detects that the liquid level of the humidifying liquid has reached an upper limit are provided, and at an upstream end portion of the humidifying liquid supply channel 106, a needle 120 for humidifying liquid is provided.

The ink tank 20 is a substantially rectangular parallelepiped container which stores the ink. In the rear surface of the ink tank 20, it is provided a memory unit (20A) which stores at least information regarding a remaining amount of the ink stored in the ink tank 20, and in the lower surface of the ink tank 20, it is provided an insertion port (not depicted) to which the needle 86 for ink is inserted. As depicted in FIG. 2, the treatment liquid tank 22 is a substantially rectangular parallelepiped container which stores the treatment liquid. In the rear surface of the treatment liquid tank 22, it is provided a memory unit 22A which stores at least information regarding a remaining amount of the treatment liquid stored in the treatment liquid tank 22, and in the lower surface of the treatment liquid tank 22, it is provided an insertion port (not depicted) to which the needle 98 for treatment liquid is inserted. The humidifying liquid tank 24 is a substantially rectangular parallelepiped container which stores the humidifying liquid, and in the lower surface of the humidifying liquid tank 24, it is provided an insertion port (not depicted) to which the needle 120 for humidifying liquid is inserted. As depicted in FIG. 2, the tank installation part 26 houses the ink tank 20, the treatment liquid tank 22, and the humidifying liquid tank 24. Further, on the humidifying liquid tank 24, a remaining amount sensor 156 (FIG. 4) which detects that an amount of the humidifying liquid stored in the humidifying liquid tank 24 is equal to or less than a second predetermined amount is attached.

<Electrical Configuration>

Figure 4:
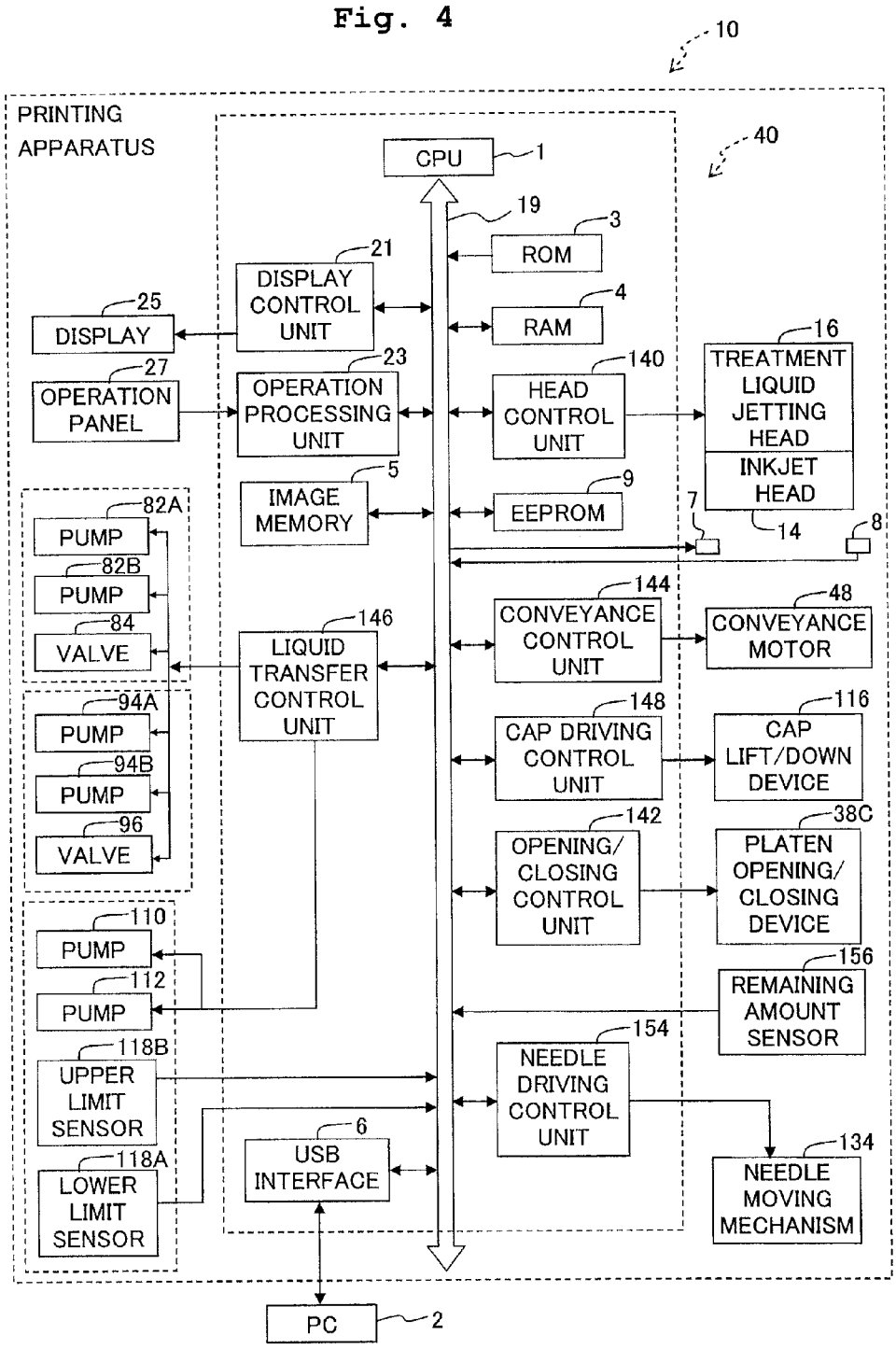
FIG. 4 is a block diagram depicting an electrical configuration of the ink-jet printer.
Figure 5:
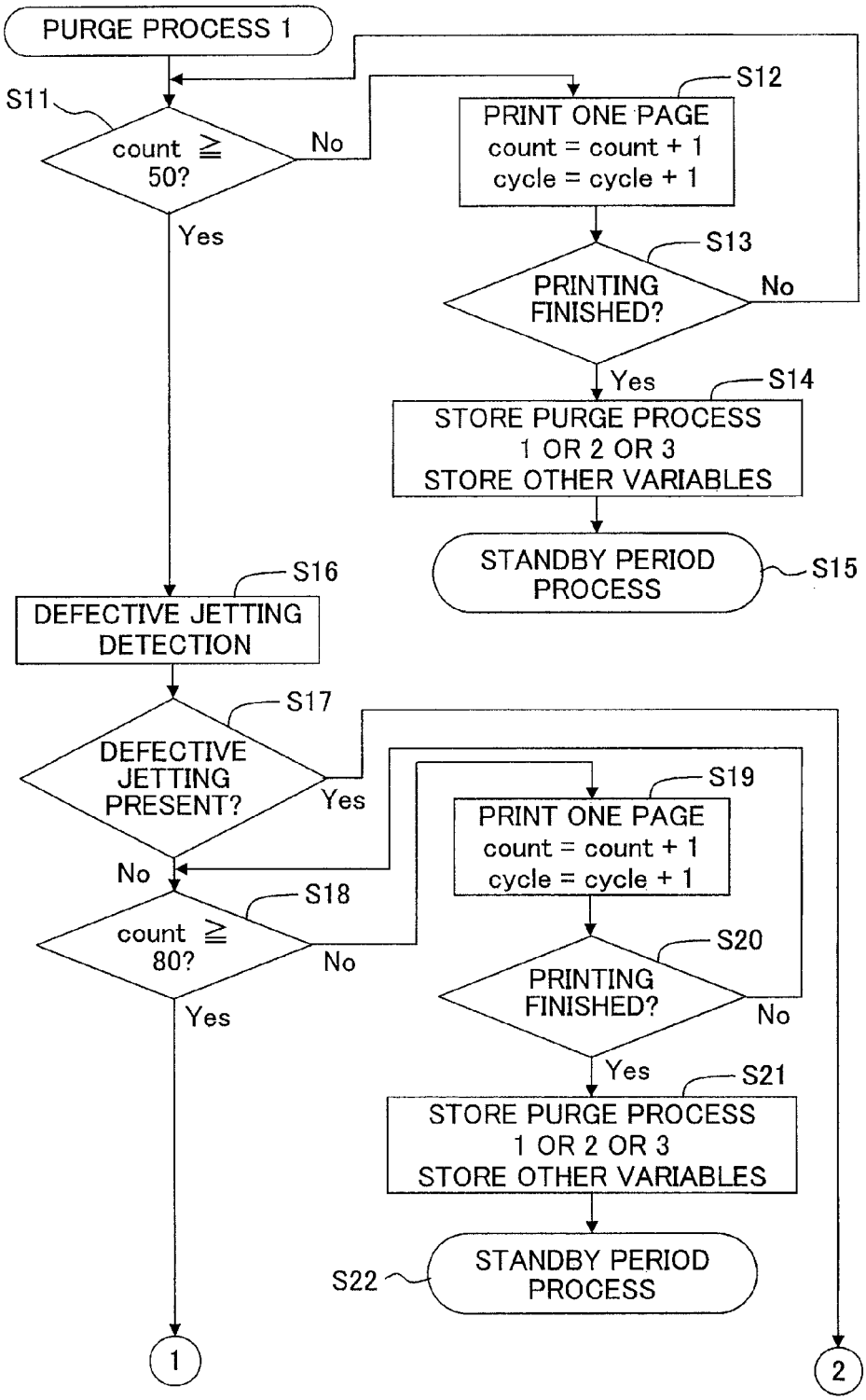
FIG. 5 is a flowchart depicting a first half of a purge process 1 of the ink-jet printer.

Next, an electrical configuration of the ink-jet printer 10 will be explained with reference to FIG. 4. As depicted in FIG. 4, the ink-jet printer 10 includes the control unit 40. The control unit 40 includes a ROM 3, a RAM 4, an image memory 5, a USB interface 6, a light-emitting element 7, a light-receiving element 8, an EEPROM (product name) 9, a display control unit 21, an operation processing unit 23, a head control unit 140, an opening/closing control unit 142, a conveyance control unit 144, a liquid transfer control unit 146, a cap driving control unit 148, and a needle driving control unit 154 which are connected to a CPU 1 via a data bus 19. The CPU 1 controls the ink-jet printer 10. The ROM 3 stores programs executed by the CPU 1 and various kinds of data. The RAM 4 temporarily stores data during the execution of the programs. The image memory 5 stores image data developed for printing. The EEPROM 9 being a nonvolatile memory stores variables "count", "count2", "cycle", "High", "Low", M.R., and so on which will be described later. The USB interface 6 communicates with a personal computer (hereinafter, referred to as the "PC") 2. The display control unit 21 performs various kinds of displays on a display 25 according to instructions from the CPU 1. The operation processing unit 23 transfers an input from an operation panel 27 to the CPU 1. The head control unit 140 controls the jetting of the ink from the inkjet head 14 and the jetting of the treatment liquid from the treatment liquid jetting head 16. The light-emitting element 7 is constituted of a semiconductor light-emitting element such as LED, for instance, and emits light toward the light-receiving element 8. The light-receiving element 8 is constituted of a photodiode or the like. The defective jetting of the ink from the nozzle of the inkjet head 14 is detected by using the light-emitting element 7 and the light-receiving element 8. The liquid transfer control unit 146 controls the pumps 82A, 82B, 94A, 94B, 110, 112 and the valves 84, 96. The needle driving control unit 154 controls a needle moving mechanism 134 which moves the needle 86 for ink.

The conveyance control unit 144 controls a conveyor motor 48 which conveys the sheet P being the recording medium. The cap driving control unit 148 controls the cap lifting devices 116 each of which lifts up and down the cap 100. The opening/closing control part 142 controls the platen opening/closing units 38C each of which controls the opening/closing of the platen 38. The remaining amount sensor 156 detects that an amount of the humidifying liquid stored in the humidifying liquid tank 24 is equal to or less than a second predetermined amount. The upper limit sensor 118B detects that the liquid level of the humidifying liquid has reached the upper limit. The lower limit sensor 118A detects that the liquid level of the humidifying liquid has reached the lower limit.

<Printing Operation>

Next, a printing operation of the ink-jet printer 10 of the present embodiment will be explained with reference to FIG. 2. In the printing operation, the sheet P in the sheet storage unit 30 is taken out by the pickup roller 46, and this sheet P is fed to the pre-treatment region Q2 and the recording region Q1 via the feed path 34B and the horizontal path 34A and is thereafter discharged to the discharge unit 32 via the discharge path 34C. In the pre-treatment region Q2, the treatment liquid is jetted to the sheet P from the jetting port (not depicted) of the treatment liquid jetting head 16, and in the recording region Q1, the ink droplets 14B are jetted to the sheet P from the nozzles 14A (see, FIG. 3) of the inkjet head 14. Jetting amount of the ink from the inkjet head 14, jetting amount of the treatment liquid from the treatment liquid jetting head 16, the remaining amount of the ink stored in the ink tank 20, and the remaining amount of the treatment liquid stored in the treatment liquid tank 22 are calculated based on image data and so on. Then, when the ink and the treatment liquid are jetted, the remaining amounts of the ink and the treatment liquid are written to the RAM 4. Whether or not the ink and the treatment liquid are jetted is determined by the CPU 1 of the control unit 40 based on the image data and so on.

<Maintenance Operation>

Next, a chief maintenance operation of the ink-jet printer 10 will be explained. Types of the maintenance operation include flushing and purging (hereinafter, also referred to as "purge"). The flushing is an operation in which the actuators (not depicted) of the inkjet head 14 is driven based on flushing data different from the image data to thereby forcibly discharge the ink from the nozzles 14A (FIG. 3) of the inkjet head 14, or an operation in which the actuators (not depicted) of the treatment liquid jetting head 16 is driven based on the flushing data to thereby forcibly discharge the treatment liquid from the jetting port (not depicted) of the treatment liquid jetting head 16. On the other hand, the purging is an operation in which a pressure is applied to the ink in the inkjet head 14 (FIG. 2) by the pump 82B (FIG. 2 and FIG. 4) to thereby forcibly discharge the ink from the nozzles 14A (FIG. 3), or an operation in which a pressure is applied to the treatment liquid in the treatment liquid jetting head 16 (FIG. 2) by the pump 94B (FIG. 2 and FIG. 4) to thereby forcibly discharge the treatment liquid from the jetting port (not depicted) of the treatment liquid jetting head 16.

In the maintenance operation, the two caps 100 are lifted up by the cap lifting devices 116, so that the nozzles 14A of the inkjet head 14 and the jetting ports of the treatment liquid jetting head 16 are covered by the two caps 100, respectively. Then, the flushing or the purging is executed, and the ink jetted or discharged from the inkjet head 14 is received by one of the caps 100 and the treatment liquid jetted or discharged from the treatment liquid jetting head 16 is received by the other of the caps 100. The ink and the treatment liquid each received by the cap 100 is discharged from a discharge port (not depicted) provided in the cap 100.

In the flushing, jetting amount of the ink from the inkjet head 14, jetting amount of the treatment liquid from the treatment liquid jetting head 16 (FIG. 2), the remaining amount of the ink stored in the ink tank 20, and the remaining amount of the treatment liquid stored in the treatment liquid tank 22 (FIG. 2) are calculated based on the flushing data and so on. Then, when the ink and the treatment liquid are jetted, the remaining amounts of the ink and the treatment liquid are written to the RAM 4. Whether or not the ink and the treatment liquid are jetted is determined by the CPU 1 based on the flushing data and so on.

<Defective Jetting Detecting Mechanism and Defective Jetting Detecting Method>

Next, a mechanism for detecting a defective jetting nozzle (hereinafter, also referred to as "defective jetting detection") and a defective jetting detecting method will be explained with reference to FIG. 3. The light-emitting element 7 and the light-receiving element 8 are disposed to face each other so that trajectories of the ink droplets 14B from the nozzles 14A arranged in the ink jetting head 14 are positioned between the light-emitting element 7 and the light-receiving element 8. An optical path 7A of the light emitted from the light-emitting element 7 and travels toward the light-receiving element 8 is parallel to an arrangement direction of the nozzles 14A. The light radiated from the light-emitting element 7 enters the light-receiving element 8 placed to directly face the light-emitting element 7. Then, in an operation for detecting jetting failure, for example, each nozzle 14 is made to perform one or more jetting operation(s) for jetting the ink droplet 14B, in turn from the nozzle 14A arranged at one end of the inkjet head 14 to the nozzle 14A arranged at the other end of the inkjet head 14. Then, based on output results of the light-receiving element 8, the CPU 1 detects the presence/absence of the occurrence of the jetting failure. Specifically, when no ink droplet 14B exists on the optical path 7A, the light emitted from the light-emitting element 7 reaches the light-receiving element 8 as it is. On the other hand, when the ink droplet 14B cuts across the optical path 7A, a light receiving amount of the light-receiving element 8 decreases, and thus, a level of an output signal from the light-receiving element 8 lowers. When the level of the output signal lowers, the CPU 1 determines that no jetting failure has occurred, and when the level of the output signal is not lowered, the CPU 1 determines that the jetting failure has occurred.

<Control Over Detection of Jetting Failure>

Next, the control over the detection of the jetting failure of the ink-jet printer 10 of the present embodiment will be explained with reference to flowcharts in FIG. 5 to FIG. 8B. Programs presented in the flowcharts in FIG. 5 to FIG. 8B are stored in the ROM 3 depicted in FIG. 4, and the CPU 1 reads the programs from the ROM 3 to execute them. In the following explanation, a value of "count" is a value of the total number of copies printed by the ink-jet printer 10 and is a value indicating the total number of the printed copies from the start of the use of the ink-jet printer 10. Further, a value of "cycle" is a variable for deciding a proper purge cycle. Values of "count" and "cycle" are stored in the EEPROM 9. In a purge process 1, the CPU 1 of the ink-jet printer 10 receives print data from the PC 2 and develops the print data as data for printing in the image memory 5. Next, the CPU 1 controls the conveyance motor 48 via the conveyance control unit 144 to convey the sheet P to a printing position.

Next, the CPU 1 determines whether or not the value of "count" being the total number of printed copies is equal to or more than 50 (S11). This "50" is an example of a first condition value and is stored in the EEPROM 9. When the value of "count" is less than 50 (S11: NO), the CPU 1 reads print data for one line from the image memory 5 and causes, via the head control unit 140, the nozzles 14A of the inkjet head 14 to jet the ink. This operation is repeated to complete printing for one piece of the sheet P. Thereafter, the CPU 1 sets "count"="count"+1, that is, adds 1 to the value of "count" (S12). Further, the CPU 1 sets the variable "cycle" for deciding the proper purge cycle to "cycle"="cycle"+1, that is, adds 1 to the value of "cycle" (S12). An initial value of "count" is "0" and an initial value of "cycle" is also "0". Therefore, after the process at step S12 performed for the first time, "count"=1 and "cycle"=1. Next, the CPU 1 determines whether or not the printing is finished (S13), and when the printing is not finished (S13: NO), the CPU 1 returns the processing to S11. Thereafter, by process at step S12, "1" is added each time to the value of "count" and the value of "cycle". Next, the CPU 1 determines whether or not the printing is finished (S13), and when the printing is not finished (S13: NO), the CPU 1 returns the processing to S11. Thereafter, this processing is repeated. Further, when the printing is finished (S13: YES), the CPU 1 stores, in the EEPROM 9, information indicating that whether the process currently performed is the purge process 1, a purge process 2 which will be described later or a purge process 3 which will be described later (i.e. that the purge process 1 is currently being executed, in this stage) and the value of "count" and the value of "cycle" which are the other variables, and so on (S14). Thereafter, the CPU 1 executes a standby period process in which each control unit is brought into a sleep state (S15).

If the value of "count" is equal to or more than 50 (S11: YES), this mean that the total number of printed copies reaches 50 or more, and thus, the CPU 1 executes the above-described defective jetting detection (S16). When the defective jetting is present (S17: YES), the CPU 1 executes the purge of the inkjet head 14 (S42). In this purge, the CPU 1 executes the above-described purging process which is explained in the section of the maintenance operation of the ink-jet printer 10. In this case, since the jetting failure occurred when the number of printed copies was not less than 0 and less than 50, the CPU 1 sets a variable "High"=50 and a variable "Low"=0 and stores them in the EEPROM 9 (S43). Next, the CPU 1 sets the variable "cycle"=25 and stores it in the EEPROM 9 (S44). That is, the value of "cycle" is set to an intermediate value "25" between 0 and 50. This "cycle"=25 is an example of a "second condition value". The CPU 1 shifts the processing to a purge process 3 (to be described later) (S45).

When the defective jetting is not present (S17: NO), the CPU 1 determines whether or not the value of "count" being the total number of printed copies is equal to or more than 80 (S18). This "80" is an example of a third condition value and is stored in the EEPROM 9. When the value of "count" is less than 80 (S18: NO), the CPU 1 reads print data for one line from the image memory 5 and causes, via the head control unit 140, the nozzles 14A of the inkjet head 14 to jet the ink. This operation is repeated to complete the printing for one piece of the sheet P. Further, the CPU 1 sets "count"="count"+1, that is, adds 1 to the value of "count" (S19). Further, the CPU 1 sets "cycle"="cycle"+1, that is, adds 1 to the value of "cycle" (S19). Next, the CPU 1 determines whether or not the printing is finished (S20), and when the printing is not finished (S20: NO), the CPU 1 returns the processing to S18. Further, when the printing is finished (S20: YES), the CPU 1 stores, in the EEPROM 9, information indicating that the purge process 1 is currently being executed, and the value of "count" and the value of "cycle" which are the other variables (S21). Thereafter, the CPU 1 executes the standby period process in which each control part is brought into the sleep state (S22).

If the value of "count" is equal to or more than 80 (S18: YES), this means that the total number of printed copies reaches 80 or more, and thus the CPU 1 performs the aforesaid defective jetting detection (S23). When the defective jetting is present (S24: YES), the CPU 1 executes the purge of the inkjet head 14 (S38). In this purge, the CPU 1 executes the above-described purging process explained in the section of the maintenance operation of the ink-jet printer 10. In this case, since the jetting failure occurred when the number of printed copies was not less than 50 and less than 80, the CPU 1 sets the variable "High"=80 and the variable "Low"=50 and stores them in the EEPROM 9 (S39). Next, the CPU 1 sets the variable "cycle"=65 and stores it in the EEPROM 9 (S40). That is, the value of "cycle" is set to an intermediate value "65" between 50 and 80. This "cycle"=65 is an example of a "fourth condition value". The CPU 1 shifts the processing to the purge process 3 (to be described later) (S41).

When the defective is not present (S24: NO), the CPU 1' determines whether or not the value of "count" being the total number of printed copies is equal to or more than 100 (S25). This "100" is an example of a fifth condition value and is stored in the EEPROM 9. When the value of "count" is less than 100 (S25: NO), the CPU 1 reads print data for one line from the image memory 5 and causes, via the head control unit 140, the nozzles 14A of the inkjet head 14 to jet the ink. This operation is repeated to complete the printing for one piece of the sheet P. Further, the CPU 1 sets "count"="count"+1, that is, adds 1 to the value of "count" (S26). Further, the CPU 1 sets "cycle"="cycle"+1, that is, adds 1 to the value of "cycle" (S26). Next, the CPU 1 determines whether or not the printing is finished (S27) and when the printing is not finished (S27: NO), the CPU 1 returns the processing to S25. Further, when the printing is finished (S27: YES), the CPU 1 stores, in the EEPROM 9, information indicating that the purge process 1 is currently being executed, and the value of "count" and the value of "cycle" which are the other variables (S28). Thereafter, the CPU 1 executes the standby period process in which each control unit is brought into the sleep state (S29).

If the value of "count" is equal to or more than 100 (S25: YES), this means that the total number of printed copies reaches 100 or more, and thus, the CPU 1 executes the aforesaid defective jetting detection (S30). When the defective jetting is present (S31: YES), the CPU 1 executes the purge of the inkjet head 14 (S34). In this purge, the CPU 1 executes the above-described purging process explained in the section of the maintenance operation of the ink-jet printer 10. In this case, since the jetting failure occurred when the number of printed copies was not less than 80 and less than 100, the CPU 1 sets the variable "High"=100 and the variable "Low"=80 and stores them in the EEPROM 9 (S35). Next, the CPU 1 sets the variable "cycle"=90 and stores it in the EEPROM 9 (S36). That is, the value of "cycle" is set to an intermediate value "90" between 80 and 100. This "cycle"=90 is an example of a "sixth condition value". The CPU 1 shifts the processing to the purge process 3 (to be described later) (S37). When the defective jetting is not present (S31: NO), the CPU 1 executes the purge of the inkjet head 14 (S32). The CPU 1 shifts the processing to a purge process 2 (to be described later) (S33). At this stage, the value of "count" is "100" and the value of "cycle" is "100".

Figure 7:
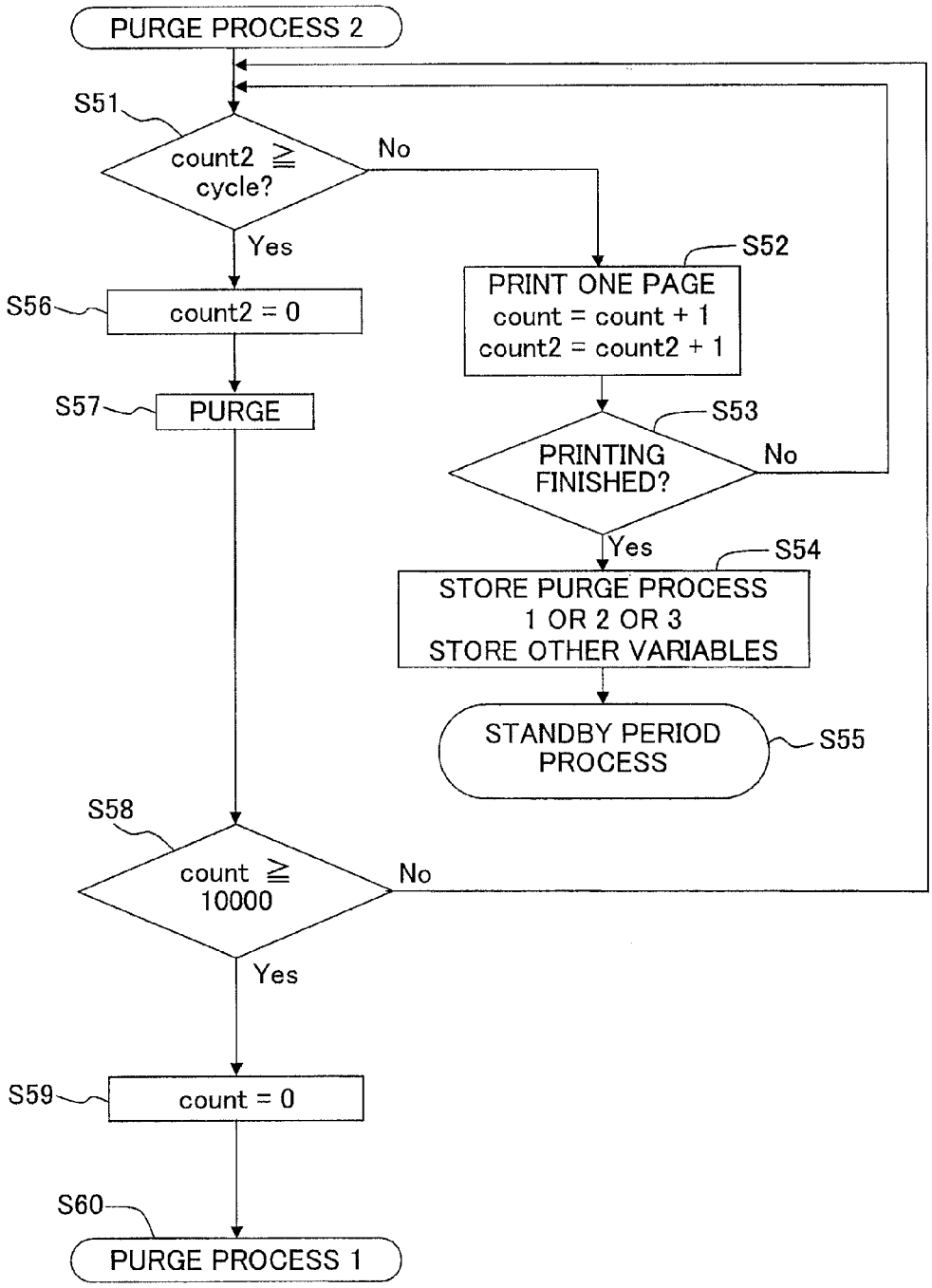
FIG. 7 is a flowchart depicting a purge process 2 of the ink-jet printer.

Next, the purge process 2 will be explained with reference to FIG. 7. A "count2" is a variable which is used when the defective jetting is not detected in the purge process 1 even when the total number of printed copies reaches 100 or more and which is a variable for re-counting the number of printed copies from zero. In the purge process 2, the CPU 1 first determines whether or not a value of "count2" is equal to or more than the value of "cycle" (S51). In the beginning of the purge process 2, the value of "count2" is an initial value "0". Further, since the value of "cycle" is "100", the CPU 1 determines that the value of "count2" is less than the value of "cycle" (S51: NO). Next, the CPU 1 reads print data for one line from the image memory 5 and causes, via the head control unit 140, the nozzles 14A of the inkjet head 14 to jet the ink. This operation is repeated to complete the printing for one piece of the sheet P (S52). Further, the CPU 1 sets "count"="count"+1, that is, adds 1 to the value of "count" (S52). Further, the CPU 1 sets "count2"="count2"+1, that is, adds 1 to the value of "count2" (S52). At this stage, "count"=101 and "count2"=1. Next, the CPU 1 determines whether or not the printing is finished (S53), and when the printing is not finished (S53: NO), the CPU 1 returns the processing to S51. Further, when the printing is finished (S53: YES), the CPU 1 stores, in the EEPROM 9, information indicating that the purge process 2 is currently being executed, and the value of "count", the value of "count2", and the value of "cycle" which are the other variables (S54). Thereafter, the CPU 1 executes the standby period process in which each control unit is brought into the sleep state (S55).

When the value of "count2" is equal to or more than the value of "cycle", that is, when the value of "count2" is equal to or more than the value "100" of "cycle" (S51: YES), the CPU 1 resets the value of "count2" to "0" (S56) and execute the purge of the inkjet head 14 (S57). Therefore, when the total number of printed copies reaches 200, the purge process is performed. Since the purge process was performed last time when the total number of printed copies reached 100 (S32), an interval of the purge process is 100 sheets. Next, the CPU 1 determines whether or not the value of "count" is 10000 or more (S58). When the value of "count" is less than 10000 (S58: NO), the CPU 1 shifts the processing to S51. Thereafter, the CPU 1 repeats the processes S51 to S58 until the value of "count" reaches 10000 or more, that, is, until the total number of printed copies reaches 10000, while executing the purge every time the number of printed copies reaches 100 being the interval of the purge process. When the value of "count" reaches 10000 or more (S58: YES), since the total number of printed copies exceeds 10000, the CPU 1 resets the value of "count" back to "0" (S59) and shifts the processing to the purge process 1 depicted in FIG. 5 and FIGS. 6A and 6B (S60), in order to execute the purge based on more fine detection of the defective jetting. A value of "10000" is an example of a "predetermined upper limit value" of the present teaching.

Figure 8A:
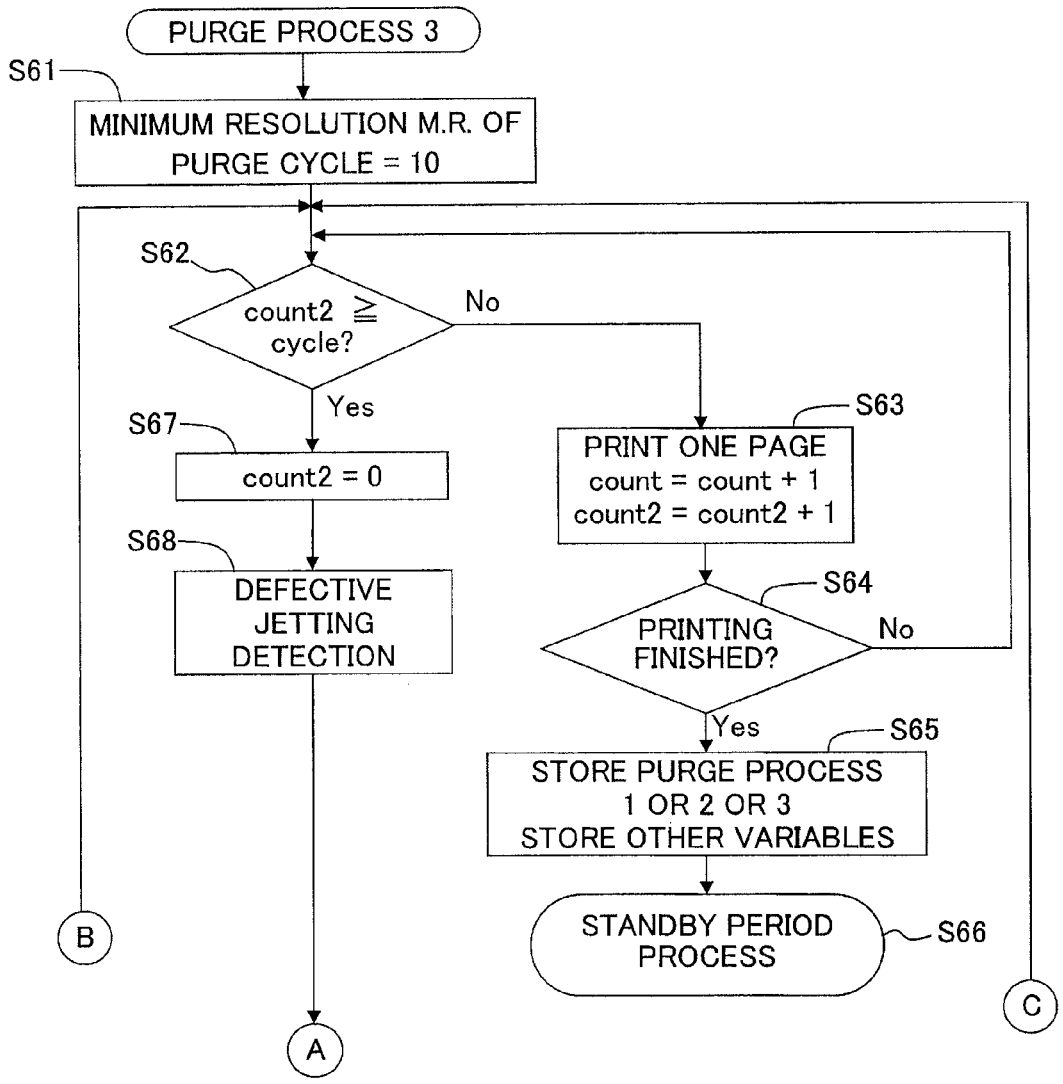
FIGS. 8A and 8B are flowcharts depicting a purge process 3 of the ink-jet printer.
Figure 8B:
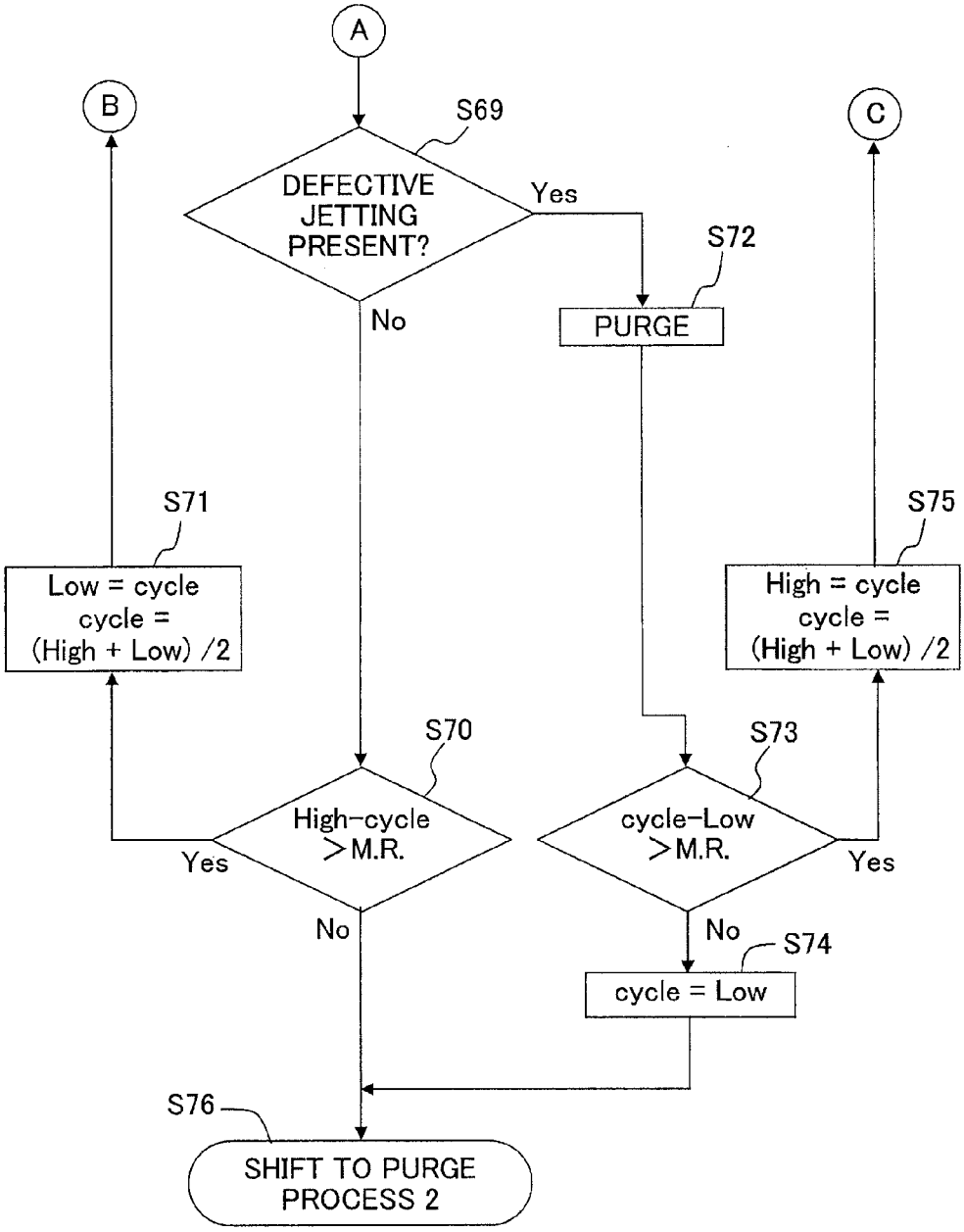

Next, the purge process 3 will be explained with reference to the flowcharts in FIGS. 8A and 8B. In the purge process 3, the CPU 1 sets the minimum resolution M.R. of the purge cycle, that is a purge process interval represented by the number of printed copies, to M.R.=10 (S61). This is because performing the defective jetting detection every time the total number of printed copies reaches less than 10 is a great waste. Further, by setting the value of M.R. to 10, it is possible for a difference between the set value of "cycle" and a value at which the defective jetting can actually occur to become 10 (value of the minimum resolution M.R.) or less. Next, the CPU 1 determines whether or not the value of "count2" is equal to or more than the value of "cycle" (S62). In the case of the purge process 3 at S37 depicted in FIG. 6A, at the beginning of the purge process 3, the value of "count2" is the initial value "0", and the value of "cycle" is "90" set at S36. Thus, the CPU 1 determines that the value of "count2" is less than the value of cycle (S62: NO).

Next, the CPU 1 reads print data for one line from the image memory 5 and causes, via the head control unit 140, the nozzles 14A of the inkjet head 14 to jet the ink. This operation is repeated to complete the printing for one piece of the sheet P (S63). Further, the CPU 1 sets "count"="count"+1, that is, adds 1 to the value of "count" (S63). Further, the CPU 1 sets "count2"="count2"+1, that is, adds 1 to the value of "count2" (S63). At this stage, "count"=101 and "count2"=1. Next, the CPU 1 determines whether or not the printing is finished (S64), and when the printing is not finished (S64: NO), the CPU 1 returns the processing to S62. Further, when the printing is finished (S64: YES), the CPU 1 stores, in the EEPROM 9, information indicating that the purge process 3 is currently being executed, and the value of "count", the value of "count2", and the value of "cycle" which are the other variables (S65). Thereafter, the CPU 1 executes the standby period process in which each control unit is brought into the sleep state (S66).

When the value of "count2" is equal to or more than the value of "cycle", that is, when the value of "count2" is equal to or more than the value "90" of "cycle" (S62: YES), the CPU 1 resets the value of "count2" to "0" (S67), and executes the defective jetting detection (S68) to determine whether or not the defective jetting is present (S69). When the defective jetting is present (S69: YES), the CPU 1 executes the purge of the inkjet head 14 (S72). In this purge, the CPU 1 executes the above-described purging process explained in the section of the maintenance operation of the ink jet printer 10. Thereafter, the CPU 1 determines whether or not a value obtained by subtracting the value of "Low" from the value of "cycle" is larger than the value of the minimum resolution M.R. (S73). In the case of the purge process 3 at S37 depicted in FIG. 6A, "cycle"=90, "Low"=80, and M.R.=10, and therefore, "cycle"−"Low"=10, and thus, the CPU 1 determines that the value of "cycle"−"Low" is not larger than MR. (S73: NO). Next, the CPU 1 sets "cycle"="Low" (S74). Here, the value of "cycle" is 80 (S74). Therefore, an interval of the defective jetting detection is "80 sheets". Thereafter, the CPU 1 shifts the processing to the purge process 2 depicted in FIG. 7 (S76).

When the defective is not present (S69: NO), the CPU 1 determines whether or not a value obtained by subtracting the value of "cycle" from the value of "High" is larger than the value of the minimum resolution M.R. (S70). In the case of the purge process 3 at S37 depicted in FIG. 6A, "cycle"=90, "High"=100, and M.R.=10, and therefore, "High"−"cycle"=10, and the CPU 1 determines that the value of "High"-"cycle" is not larger than M.R. (S70: NO). Thereafter, the CPU 1 shifts the processing to the purge process 2 depicted in FIG. 7 (S76).

Figure 6A:
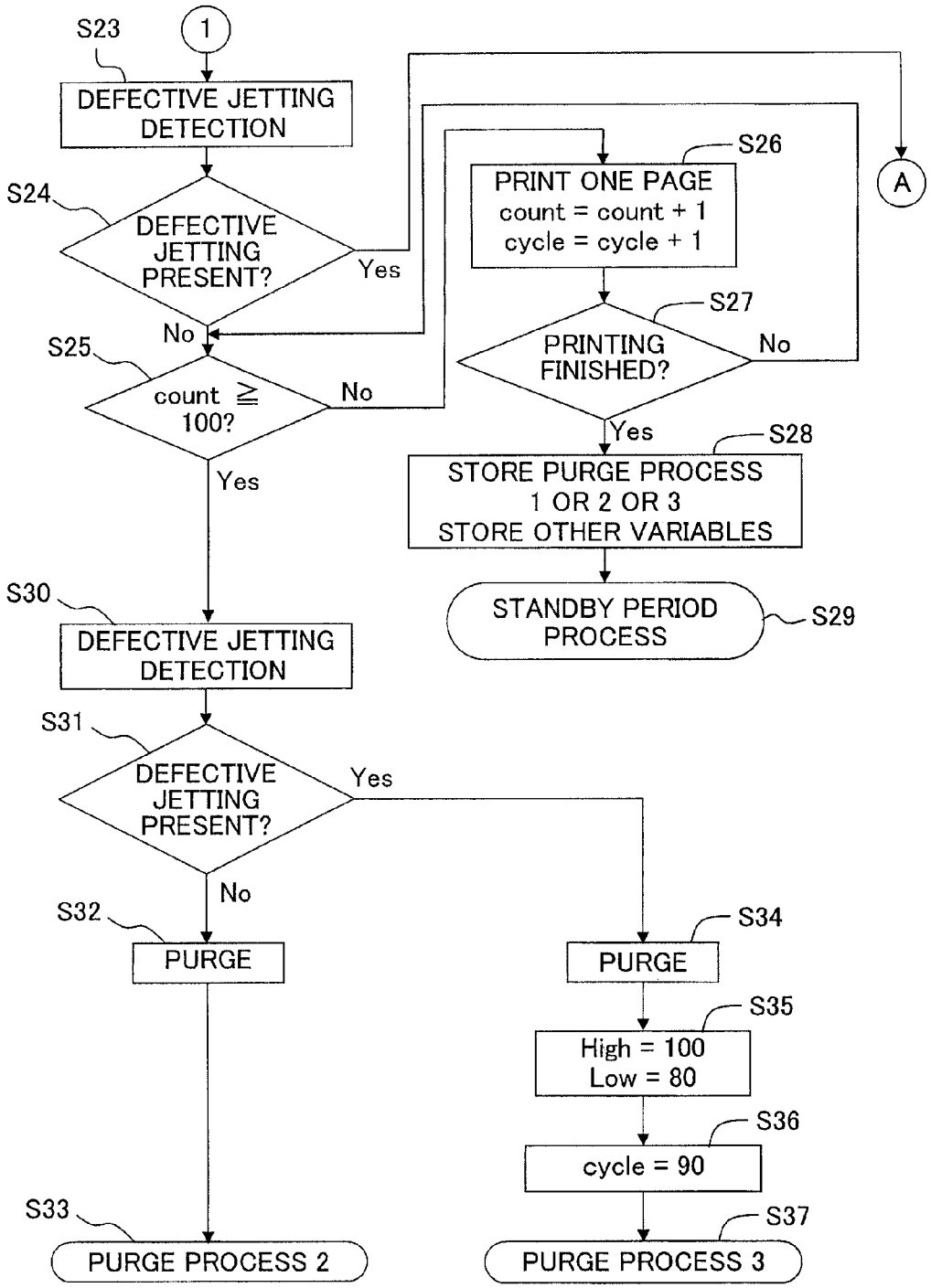
FIGS. 6A and 6B are flowcharts depicting a latter half of the purge process 1 of the ink-jet printer.
Figure 6B:
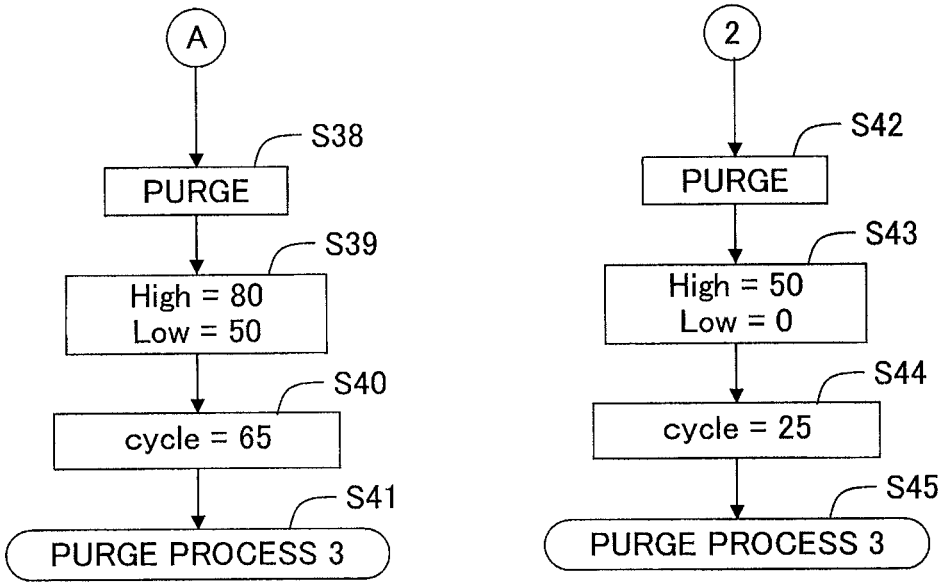

Next, the case of the purge process 3 (S41) depicted in FIG. 6B will be explained with reference to the flowchart of the purge process 3 in FIGS. 8A and 8B. In this case, "count"=80, "High"=80, "Low"=50, and "cycle"=65. Hereinafter, only processes which are different from those of the above-described purge process 3 at S37 will be explained. In the determination process at S62, when the value of "count2" is equal to or more than the value of "cycle", that is, when the value of "count2" is equal to or more than the value "65" of "cycle" (S62: YES), the CPU 1 resets the value of "count2" to "0" (S67) and executes the defective jetting detection (S68). When the defective jetting is present (S69: YES), the CPU 1 executes the purge of the inkjet head 14 (S72). In this purge, the CPU 1 executes the above-described purging process explained in the section of the maintenance operation of the ink-jet printer 10. Thereafter, the CPU 1 determines whether or not a value obtained by subtracting the value of "Low" from the value of "cycle" is larger than the value of the minimum resolution M.R. (S73). In the case of the purge process 3 at S41 depicted in FIG. 6B, "cycle"=65, "Low"=50, and M.R.=10, and thus, "cycle"−"Low"=15. Accordingly, the CPU 1 determines that the value of "cycle"−"Low" is larger than M.R. (S73: YES). Next, the CPU 1 sets "High"="cycle" (S75). Here, the value of "High" is 65 (S75). Further, the CPU 1 calculates "cycle"=("High"+"Low")/2 (S75). In this case, "cycle"=(65+50)/2=57.5. Therefore, the interval of the defective jetting detection is "57.5 sheets" or more, that is, "58 sheets". Next, the CPU 1 shifts the processing to S62.

When the defective jetting is not present (S69: NO), the CPU 1 determines whether or not a value obtained by subtracting the value of "cycle" from the value of "High" is larger than the value of the minimum resolution M.R. (S70). In the case of the purge process 3 at S41 depicted in FIG. 6B, "cycle"=65, "High"=80, and M.R.=TO, and thus, "High"−"cycle"=15. Accordingly, the CPU 1 determines that the value of "High"−"cycle" is larger than M.R. (S70: YES). Next, the CPU 1 sets "Low"="cycle" (S71). Here, the value of "Low" is 65 (S71). Further, the CPU 1 calculates "cycle"=("High"+"Low")/2 (S71). In this case, "cycle"=(80+65)/2=72.5. Therefore, the interval of the defective jetting detection is "72.5 sheets" or more, that is, "73 sheets". Next, the CPU 1 shifts the processing to S62.

Next, the case of the purge process 3 (S45) depicted in FIG. 6B will be explained with reference to the flowcharts of the purge process 3 in FIGS. 8A and 8B. In this case, "count"=50, "High"=50, "Low"=0, and "cycle"=25. Hereinafter, only processes which are different from those of the above-described purge process 3 at S37 will be explained. In the determination process at S62, when the value of "count2" is equal to or more than the value of "cycle", that is, when the value of "count2" is equal to or more than the value "25" of "cycle" (S62: YES), the CPU 1 resets the value of "count2" to "0" (S67) and executes the defective jetting detection (S68). When the defective jetting is present (S69: YES), the CPU 1 executes the purge of the inkjet head 14 (S72). In this purge, the CPU 1 executes the above-described purging process explained in the section of the maintenance operation of the ink-jet printer 10. Thereafter, the CPU 1 determines whether or not a value obtained by subtracting the value of "Low" from the value of "cycle" is larger than the value of the minimum resolution M.R. (S73). In the case of the purge process 3 at S45 depicted in FIG. 6B, "cycle"=25, "Low"=0, and M.R.=10, and thus, "cycle"−"Low"=25. Accordingly, the CPU 1 determines that the value of "cycle"−"Low" is larger than M.R. (S73: YES). Next, the CPU 1 sets "High"="cycle" (S75). Here, the value of "High" is 25 (S75). Further, the CPU 1 calculates "cycle"=("High"+"Low")/2 (S75). In this case, "cycle"=(25+0)/2=12.5. Therefore, the interval of the defective jetting detection is "12.5 sheets" or more, that is, "13 sheets". Next, the CPU 1 shifts the processing to S62.

When the defective jetting is not present (S69: NO), the CPU 1 determines whether or not a value obtained by subtracting the value of "cycle" from the value of "High" is larger than the value of the minimum resolution M.R. (S70). In the case of the purge process 3 at S45 depicted in FIG. 6B, "cycle"=25, "High"=50, and M.R.=10, and thus, the value of "High"−"cycle"=25. Accordingly, the CPU 1 determines that the value of "High"−"cycle" is larger than M.R. (S70: YES). Next, the CPU 1 sets "Low"="cycle" (S71). Here, the value of "Low" is 25 (S71). Further, the CPU 1 calculates "cycle"=("High"+"Low")/2. In this case, "cycle"=(50+25)/2=37.5. Therefore, the interval of the defective jetting detection is "37.5 sheets" or more, that is, "38 sheets". Next, the CPU 1 shifts the processing to S62.

<Standby Period Process>

Figure 9:
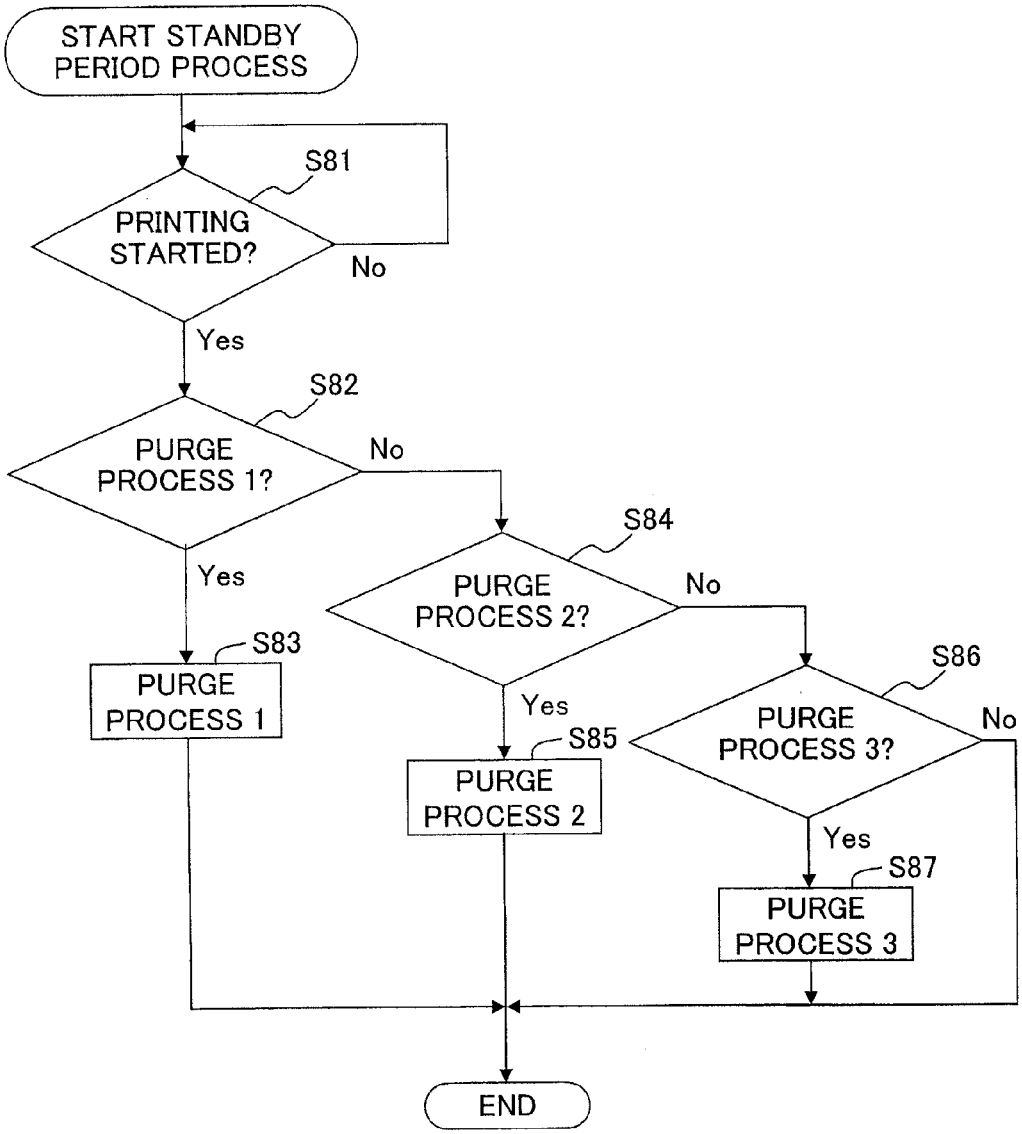
FIG. 9 is a flowchart depicting a standby period process of the ink-jet printer.

Next, the standby period process of the ink-jet printer 10 will be explained with reference to the flowchart of the standby period process depicted in FIG. 9. When receiving a print start instruction from the PC 2 (S81:YES), the CPU 1 of the ink-jet printer 10 refers to the EEPROM 9 to determine whether a state before entering a standby period is the purge process 1 or not (S82), the purge process 2 or not (S84), and the purge process 3 or not (S86). When the purge process 1 is stored in the EEPROM 9 (S82: YES), the CPU 1 executes the purge process 1 (S83). When the purge process 2 is stored in the EEPROM 9 (S82: NO, S84: YES), the CPU 1 executes the purge process 2 (S85). When the purge process 3 is stored in the EEPROM 9 (S82: NO, S84: NO, S86: YES), the CPU 1 executes the purge process 3 (S87).

Effects of Embodiment

As explained hitherto, the CPU 1 of the ink-jet printer 10 of the above-described embodiment detects whether or not the jetting failure of the inkjet head 14 is present, by using the light-emitting element 7 and the light-receiving element 8. The CPU 1 detects whether or not the jetting failure of the inkjet head 14 is present when the number of printed copies reaches 50 or more. If the jetting failure is detected at this stage, this means that the jetting failure is occurred when the number of printed copies was not less than 0 and less than 50, and thus, the CPU 1 sets the value of "cycle" being the interval of the jetting failure detection to "25". In the case where the jetting failure does not occur until the number of printed copies reaches 50, the CPU 1 detects whether or not the jetting failure of the inkjet head 14 is present, when the number of printed copies reaches 80 or more. If the jetting failure is detected at this stage, this means that the jetting failure is occurred when the number of printed copies was not less than 50 and less than 80, and thus, the CPU 1 sets the value of "cycle" being the interval of the jetting failure detection to "65". In the case where the jetting failure does not occur until the number of printed copies reaches 80, the CPU 1 detects whether or not the jetting failure of the inkjet head 14 is present, when the number of printed copies reaches 100 or more. If the jetting failure is detected at this stage, this means that the jetting failure is occurred when the number of printed copies was not less than 80 and less than 100, and thus, the CPU 1 sets the value of "cycle" being the interval of the jetting failure detection to "90". Therefore, in the ink-jet printer 10 of the above-described embodiment, it is possible to shorten the interval of the jetting failure detection if the jetting failure occurs when the number of printed copies is small, and to elongate the interval of the jetting failure detection if the jetting failure occurs when the number of printed copies is large. Therefore, wasteful jetting failure detection and recovery operation are not performed. Further, in the case where the jetting failure is not detected even when the number of printed copies exceeds 100, the purge process is repeated every time the number of printed copies reaches 100, and when the number of printed copies reaches 10000, the processing returns to the purge process 1, which performs the defective jetting detection after setting the interval of the jetting failure detection to be 50 again, for deciding the proper purge cycle. That is, when the number of printed copies exceeds 10000, paper powder accumulates in the casing and a possibility of occurrence of the jetting failure becomes high, and therefore, the proper purge cycle is decided again, thereby preventing the jetting failure.

In the above-described embodiment, the inkjet head 14 and/or the treatment liquid jetting head 16 is an example of a "printhead" of the present teaching, the pump 82B, the pump 94B, the caps 100, and the cap lifting device 116 are examples of a "recovery mechanism" of the present teaching, and the light-emitting element 7 and the light-receiving element 8 are examples of a "jetting failure detector" of the present teaching. The EEPROM 9 is an example of an "operation history memory" and a "detection condition memory" of the present teaching, and the CPU 1 is an example of a "controller" of the present teaching. The determination process at S11 executed by the CPU 1 is an example of a "determine whether or not the operation history of the printhead conforms to the first condition value stored in the detection condition memory" of the present teaching. The processes at S16 and S17 executed by the CPU 1 are examples of a "cause the jetting failure detector to perform a first detection to detect the presence of the jetting failure of the liquid from the printhead and determine whether or not the jetting failure of the liquid is present" of the present teaching. The processes at S42, S38, S34, and S32 executed by the CPU 1 are examples of a "cause the recovery mechanism to perform the recovery process of the printhead" of the present teaching. The processes at S43 and S44 executed by the CPU 1 are examples of a "create a second condition value smaller than the first condition value and cause the detection condition memory to store the second condition value as a new first condition value" of the present teaching. The determination process at S18 executed by the CPU 1 is an example of a "determine whether or not the operation history conforms to a third condition value larger than the first condition value" of the present teaching. The processes at S23 and S24 executed by the CPU 1 are examples of a "cause the jetting failure detector to perform a second detection to detect the presence of the jetting failure of the liquid from the printhead and determine whether or not the jetting failure of the liquid is present" of the present teaching. The processes at S39 and S40 executed by the CPU 1 are examples of a "create a fourth condition value larger than the first condition value and smaller than the third condition value and cause the detection condition memory to store the fourth condition value as the new first condition value" of the present teaching. The determination process at S25 executed by the CPU 1 is an example of a "determine whether or not the operation history conforms to a fifth condition value larger than the third condition value" of the present teaching. The processes at S30 and S31 executed by the CPU 1 are examples of a "cause the jetting failure detector to perform a third detection to detect the presence of the jetting failure of the liquid from the printhead and determine whether or not the jetting failure of the liquid is present" of the present teaching. The processes at S35 and S36 executed by the CPU 1 are examples of a "create a sixth condition value larger than the third condition value and smaller than the fifth condition value and cause the detection control memory to store the sixth condition value as the new first condition value" of the present teaching. The process at S59 executed by the CPU 1 is an example of a "return the first condition value stored in the detection condition memory to an initial value" of the present teaching. The process at S60 executed by the CPU 1 is an example of a "return the processing to the step in which whether or not the operation history of the printhead conforms to the first condition value stored in the detection condition memory is determined" of the present teaching.

It should be noted that the present teaching is not limited to the above-described embodiment, and various modifications can be made. The first condition value "50", the second condition value "25", the third condition value "80", the fourth condition value "65", the fifth condition value "100", the sixth condition value "90", and the predetermined upper limit value "10000" are all examples and can be appropriately changed. Further, the operation history of the inkjet head 14 is not limited to the number of printed copies. Other examples of the operation history are the number of jetted dots from the nozzles 14A, the number of printed lines, the driving time of the inkjet head 14, and the like. Further, the defective jetting detecting mechanism is not limited to the optical type using the light-emitting element 7 and the light-receiving element 8. A construction in which the nozzle surfaces of the nozzles 14A of the inkjet head 14 are electrically charged may be adopted and the defective jetting may be detected based on a change of an electric field caused when the ink is jetted. Further, in the purge process 1, the defective jetting detection may be performed for the first time when the value of "count" reaches 100. In this case, when the defective jetting is detected, the purge process is performed, and the setting of "High"=100, "Low"=0, and "cycle"=50 may be made.

At Step S36, Step S40, and Step S44 of the above-described embodiment, the value of "cycle" is set to the intermediate value between the value of "High" and the value of "Low". However, there is no limitation to this. At Step S36, Step S40, and Step S44, the value of "cycle" can be set to an arbitrary value between the value of "High" and the value of "Low".

At Step S71 and Step S75 of the above-described embodiment, when the found interval of the defective jetting detection is not a natural number, a value obtained by rounding up a fraction of the found value is set as the value of "cycle". However, there is no limitation to this. When the found interval of the defective jetting detection is not a natural number, a value obtained by rounding down the fraction of the found value may be set as the value of "cycle".

At Step S11, Step S18, Step S25, Step S58, and so on of the above-described embodiment, it is determined whether or not the value of "count" is equal to or more than the predetermined condition value. However, there is no limitation to this. At Step S11, Step S18, Step S25, Step S58, and so on, it may be determined whether or not any predetermined relation holds between the value of "count" and the predetermined condition value. When the determination result is YES, it can be said that the value of "count" conforms to the predetermined condition value.

The "defective jetting" or the "jetting failure" is not limited to mean the state where the ink droplets 14B are not jetted when the ink droplets 14B should be jetted. The control of the above described embodiment may be performed by providing a mechanism which detects a state where liquid droplets with a predetermined size are not jetted based on a change of an electrostatic capacitance and by detecting, as "defective jetting" or the "jetting failure", that the liquid droplets with the predetermined size are not jetted. Alternatively, The control of the above described embodiment may be performed by providing a mechanism which detects a state where the liquid droplets are not jetted in a predetermined direction and by detecting, as "defective jetting" or the "jetting failure", that the liquid droplets are not jetted in the predetermined direction. Further, a hardware configuration of the control unit which executes the various processes explained in the above-described embodiment is not limited to the hardware configuration including the CPU, the RAM, the ROM, and the EEPROM explained in the above-described embodiment. It goes without saying that the hardware configuration can be embodied by appropriately combining various well-known mechanisms.

What is claimed is:

1. A printing apparatus comprising:

a printhead including a plurality of nozzles configured to jet a liquid to a recording medium;

a recovery mechanism configured to perform a recovery process of the printhead;

a jetting failure detector configured to detect a presence of a jetting failure of the liquid from the printhead;

an operation history memory configured to store an operation history of the printhead;

a detection condition memory configured to store a first condition value of the operation history, the jetting failure detector performing a detection to detect the presence of the jetting failure based on the first condition value; and a controller configured to control the printing apparatus, wherein the controller is configured to control the printing, apparatus to:

determine whether or not the operation history of the printhead conforms to the first condition value stored in the detection condition memory;

cause the jetting failure detector to perform a first detection to detect the presence of the jetting failure of the liquid from the printhead and determine whether or not the jetting failure of the liquid is present, in a case that, the operation history of the printhead is determined to conform to the first condition value;

cause the recovery mechanism to perform the recovery process of the printhead, in a case that, the jetting failure of the liquid from the printhead is determined to be present based on the first detection; and create a second condition value smaller than the first condition value and cause the detection condition memory to store the second condition value as a new first condition value, in a case that, the jetting failure of the liquid from the printhead is determined to be present based on the first detection.

2. The printing apparatus according to claim 1, wherein the controller is configured to control the printing apparatus to:

determine whether or not the operation history conforms to a third condition value larger than the first condition value, in a case that, the jetting failure of the liquid from the printhead is not determined to be present based on the first detection;

cause the jetting failure detector to perform a second detection to detect the presence of the jetting failure of the liquid from the printhead and determine whether or not the jetting failure of the liquid is present, in a case that, the operation history of the printhead is determined to conform to the third condition value; and create a fourth condition value larger than the first condition value and smaller than the third condition value and cause the detection condition memory to store the fourth condition value as the new first condition value, in a case that, the jetting failure of the liquid from the printhead is determined to be present based on the second detection.

3. The printing apparatus according to claim 2, wherein the controller is configured to control the printing apparatus to:

determine whether or not the operation history conforms to a fifth condition value larger than the third condition value, in a case that, the jetting failure of the liquid from the printhead is not determined to be present based on the second detection;

cause the jetting failure detector to perform a third detection to detect the presence of the jetting failure of the liquid from the printhead and determine whether or not the jetting failure of the liquid is present, in a case that, the operation history of the printhead is determined to conform to the fifth condition value; and create a sixth condition value larger than the third condition value and smaller than the fifth condition value and cause the detection control memory to store the sixth condition value as the new first condition value, in a case that, the jetting failure of the liquid from the printhead is determined to be present based on the third detection.

4. The printing apparatus according to claim 3, wherein the controller is configured to control the printing apparatus to cause the recovery mechanism to perform the recovery process of the printhead even in a case that, the jetting failure of the liquid from the printhead is not determined to be present based on the third detection.

5. The printing apparatus according to claim 4, wherein the controller is configured to control the printing apparatus to:

return the first condition value stored in the detection condition memory to an initial value in a case that a value of the operation history of the printhead reaches an upper limit value; and then return the processing to the step in which whether or not the operation history of the printhead conforms to the first condition value stored in the detection condition memory is determined.

6. The printing apparatus according to claim 1, wherein the controller is configured to control the printing apparatus to:

return the first condition value stored in the detection condition memory to an initial value in a case that a value of the operation history of the printhead reaches an upper limit value; and then return the processing to the step in which whether or not the operation history of the printhead conforms to the first condition value stored in the detection condition memory is determined.

7. A method for detecting a defective jetting nozzle of a printing apparatus, the printing apparatus comprising:

a printhead including a plurality of nozzles configured to jet a liquid to a recording medium;

a recovery mechanism configured to perform a recovery process of the printhead;

a jetting failure detector configured to detect a presence of a jetting failure of the liquid from the printhead;

an operation history memory configured to store an operation history of the printhead;

a detection condition memory configured to store a first condition value of the operation history, the jetting failure detector performing a detection to detect the presence of the jetting failure based on the first condition value; and a controller configured to control the printing apparatus, the method comprising:

determining whether or not the operation history of the printhead conforms to the first condition value stored in the detection condition memory;

causing the jetting failure detector to perform the detection to detect the presence of the jetting failure of the liquid from the printhead and determine whether or not the jetting failure of the liquid is present, in a case that, the operation history of the printhead is determined to conform to the first condition value;

causing the recovery mechanism to perform the recovery process of the printhead, in a case that, the jetting failure of the liquid from the printhead is determined to be present; and creating a second condition value smaller than the first condition value and causing the detection condition memory to store the second condition value as a new first condition value, in a case that, the jetting failure of the liquid from the printhead is determined to be present.

* * * * *